US008552647B2

(12) United States Patent
Kloss et al.

(10) Patent No.: US 8,552,647 B2
(45) Date of Patent: Oct. 8, 2013

(54) HIGH-VOLTAGE PULSE GENERATOR AND HIGH-PRESSURE DISCHARGE LAMP HAVING A HIGH-VOLTAGE PULSE GENERATOR

(75) Inventors: Andreas Kloss, Neubiberg (DE); Steffen Walter, Oberpframmern (DE)

(73) Assignee: OSRAM Gesellschaft mit beschrankter Haftung, Munich (DE)

( * ) Notice: Subject to any disclaimer, the term of this patent is extended or adjusted under 35 U.S.C. 154(b) by 318 days.

(21) Appl. No.: 13/057,999

(22) PCT Filed: Jul. 16, 2009

(86) PCT No.: PCT/EP2009/059156

§ 371 (c)(1),
(2), (4) Date: Feb. 7, 2011

(87) PCT Pub. No.: WO2010/015498

PCT Pub. Date: Feb. 11, 2010

(65) Prior Publication Data

US 2011/0148300 A1 Jun. 23, 2011

(30) Foreign Application Priority Data

Aug. 6, 2008 (DE) ..... 10 2008 036 611

(51) Int. Cl.
*H01J 17/02* (2006.01)
*H05B 41/16* (2006.01)

(52) U.S. Cl.
USPC ..... 315/56; 315/289

(58) Field of Classification Search
USPC ..... 315/56, 57, 84.51, 234, 246, 261, 315/276, 289, 327, 344, DIG. 2
See application file for complete search history.

(56) References Cited

U.S. PATENT DOCUMENTS

| | | | | |
|---|---|---|---|---|
| 4,353,012 | A | 10/1982 | Fallier, Jr. et al. | |
| 5,567,995 | A * | 10/1996 | O'Loughlin et al. | 307/109 |
| 2002/0180572 | A1 | 12/2002 | Kakehashi et al. | |
| 2008/0130275 | A1 | 6/2008 | Higley et al. | |

FOREIGN PATENT DOCUMENTS

| | | |
|---|---|---|
| CN | 2340100 | 9/1999 |
| CN | 101165850 | 4/2008 |
| DE | 10 2005 061 832 | 6/2007 |
| DE | 10 2006 026749 | 12/2007 |
| DE | 20 2008 001026 | 4/2008 |
| DE | 10 2007 010 898 | 9/2008 |
| DE | 10 2007 010 899 | 9/2008 |
| EP | 0 974 985 | 1/2000 |
| JP | 57-182959 | 11/1982 |
| JP | 59-036922 | 2/1984 |
| JP | 62-219455 | 9/1987 |
| JP | 2006-294419 | 10/2006 |
| JP | 2007-081006 | 3/2007 |
| JP | 2009-540490 | 11/2009 |
| WO | WO 2007/074032 | 7/2007 |
| WO | WO 2007/141242 | 12/2007 |

* cited by examiner

*Primary Examiner* — Jimmy Vu
(74) *Attorney, Agent, or Firm* — Cozen O'Connor

(57) ABSTRACT

A high-voltage pulse generator based on a spiral pulse generator, wherein the spiral pulse generator is implemented as an LTCC component and is wound from at least two ceramic and at least two metal-containing layers, and the high-voltage pulse generator can be introduced into a cylindrical volume V=d2*π*3*d whose length is three times as long as the diameter of the volume, and the volume of the high-voltage pulse generator is greater than one-third of the cylindrical volume. Also disclosed is a high-pressure discharge lamp having a tubular outer piston, wherein the outer piston of the high-pressure discharge lamp has an aforesaid high-voltage pulse generator.

14 Claims, 3 Drawing Sheets

HIGH-VOLTAGE PULSE GENERATOR AND HIGH-PRESSURE DISCHARGE LAMP HAVING A HIGH-VOLTAGE PULSE GENERATOR

RELATED APPLICATIONS

This is a U.S. national stage of application No. PCT/EP2009/059156, filed on Jul. 16, 2009.

This application claims the priority of German application no. 10 2008 036 611.0 filed Aug. 6, 2008, the entire content of which is hereby incorporated by reference.

FIELD OF THE INVENTION

The invention relates to a high-voltage pulse generator based on a spiral pulse generator, wherein the spiral pulse generator is implemented as a low temperature co-fired ceramic (LTCC) component and is wound from at least two ceramic- and at least two metal-containing layers. The invention also relates to a high-pressure discharge lamp having a tubular outer piston.

BACKGROUND OF THE INVENTION

Figure 1A:
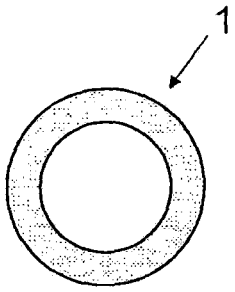
FIG 1a (Prior art)
Figure 1B:
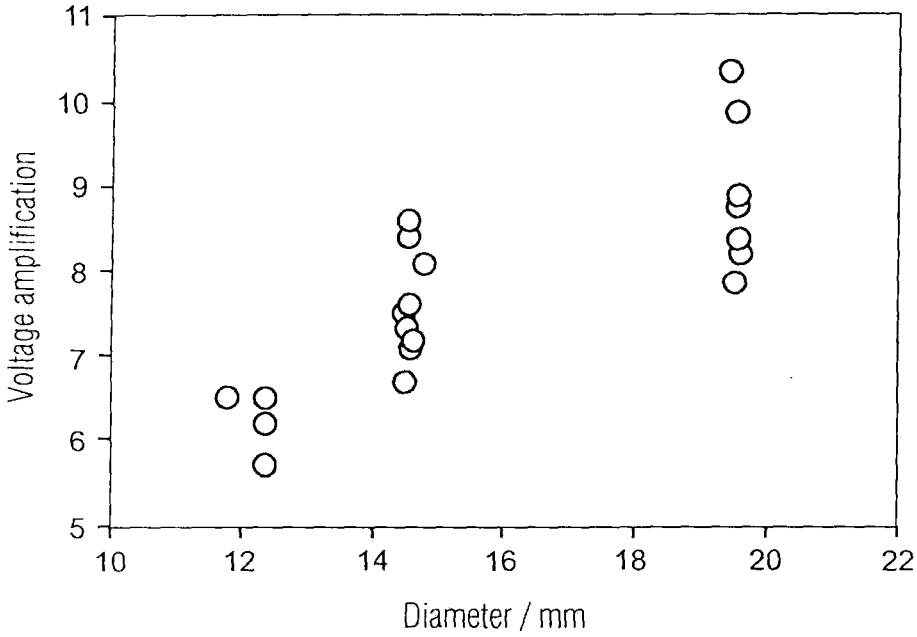
FIG 1b (Prior art)

DE 10 2005 061 832 A1 discloses a high-voltage pulse generator based on a spiral pulse generator which is implemented as an LTCC component such that it can be used in the lamp base or in the outer piston of a high-pressure discharge lamp. Said generator has, as also shown in FIG. 1*a*, a round basic shape. FIG. 1*b* shows by way of explanation here the basic relationship with regard to the voltage amplification of a spiral pulse generator as a function of its diameter. The voltage amplification increases appreciably as the diameter increases. However, the problem that reveals itself in the case of high-pressure discharge lamps which require a higher ignition voltage is that the high-voltage pulse generator which is implemented as a round spiral pulse generator becomes too large, since its output voltage $U_A$ is dependent on its geometric dimensions, specifically its external and internal diameter (AD, ID), as is expressed by the following formula: $U_A=2\times n\times U_L\times(AD-ID)/AD$, where n stands for the number of windings of the spiral pulse generator, and $U_L$ for the charging or, as the case may be, input voltage. This equation signifies that the efficiency of a spiral pulse generator is determined inter alia by the ratio of the difference between its internal and external diameter to its average diameter.

If the high-pressure discharge lamp requires a high voltage in order to ignite, i.e. in order to reach a dielectric breakdown between its electrodes, this represents a problem since then the external diameter of a suitable spiral pulse generator becomes greater than the internal diameter of the outer piston of the high-pressure discharge lamp.

SUMMARY OF THE INVENTION

One object of the invention is to provide a high-voltage pulse generator based on a spiral pulse generator, wherein the spiral pulse generator is implemented as an LTCC component and is wound from at least two ceramic and at least two metal-containing layers, which high-voltage pulse generator is embodied mechanically in such a way that it can also be used for high-pressure discharge lamps that have a slim outer piston. Another object of the invention is to provide such a high-pressure discharge lamp that has a slim outer piston and exhibits an improved ignition behavior.

These and other objects are attained in accordance with one aspect of the present invention directed to a high-voltage pulse generator based on a spiral pulse generator, wherein the spiral pulse generator is implemented as an LTCC component and is wound from at least two ceramic- and at least two metal-containing layers. The high-voltage pulse generator can be introduced into a cylindrical volume $V=d2*\pi*3*d$ whose length is three times as long as the diameter of the volume, and the volume of the high-voltage pulse generator is greater than a third of the cylindrical volume. Surprisingly it has in fact been shown that the ignition voltage which can be emitted by the spiral pulse generator does not drop significantly if the spiral pulse generator has a shape that is flattened in one direction, such as e.g. an oval shape, rather than a round shape.

In this case the high-voltage pulse generator possesses a hollow cylindrical shape departing from circularity. What is considered to be a hollow cylindrical shape in this context is a cylindrical shape which is penetrated by a cylindrical shape that is smaller in diameter but exactly the same length. Particularly preferably the outline of the high-voltage pulse generator in this case corresponds to a closed curve departing from circularity, such as e.g. an oval shape in a first embodiment variant. What is designated as an oval shape in this context is a shape having the properties that any straight line intersects the oval at a maximum of two points and any point on the oval has precisely one tangent. The side view of the high-voltage pulse generator in this case corresponds to the shape of an oval ring.

In a second embodiment variant the outline of the high-voltage pulse generator corresponds to a curve having two opposite parallel straight lines which are in each case connected at two opposite points of the straight line by a semicircle. This shape can be visualized as similar to the ground plan of the Circus Maximus. The side view then corresponds analogously to the shape of a ring whose outline corresponds to two opposite parallel straight lines which are in each case connected at two opposite points of the straight line by a semicircle.

The eccentricity of the high-voltage pulse generator in this case preferably lies between 1 and 10, particularly preferably between 1.5 and 3. What is considered as eccentricity in this context is the ratio of the diameters of the high-voltage pulse generator in directions radially offset by 90°.

An embodiment of a high-pressure discharge lamp having a tubular outer piston comprises an outer piston that has a high-voltage pulse generator having one or more of the aforementioned features. In this case the outer piston of the high-pressure discharge lamp preferably has an internal diameter of 18-25 mm.

The high-pressure discharge lamp in this case preferably has a wiring scheme of the spiral pulse generator which generates the charging voltage of the spiral pulse generator by means of resonance magnification. The wiring can in this case be accommodated in the lamp base, though it can also be housed together with the spiral pulse generator in the outer piston of the high-pressure discharge lamp.

BRIEF DESCRIPTION OF THE DRAWING(S)

The invention is explained in more detail below with reference to exemplary embodiments and the attached drawings, in which:

FIG. 1*a* shows a round spiral pulse generator according to the prior art.

FIG. 1*b* is a diagram showing the relationship with regard to the voltage amplification of a spiral pulse generator according to the prior art as a function of its diameter.

Figure 2A:
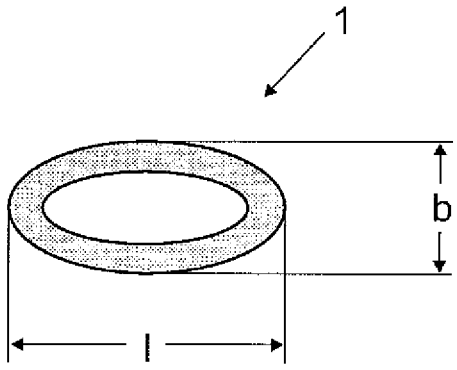

FIG. 2*a* shows an oval spiral pulse generator of a first embodiment variant.

Figure 2B:
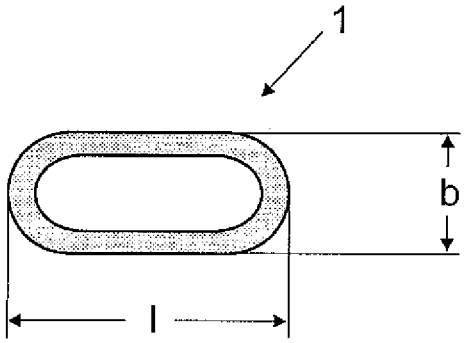

FIG. 2*b* shows a spiral pulse generator of a second embodiment variant whose outline corresponds to a curve having two opposite parallel straight lines which are in each case connected at two opposite points of the straight line by a semicircle.

Figure 3:
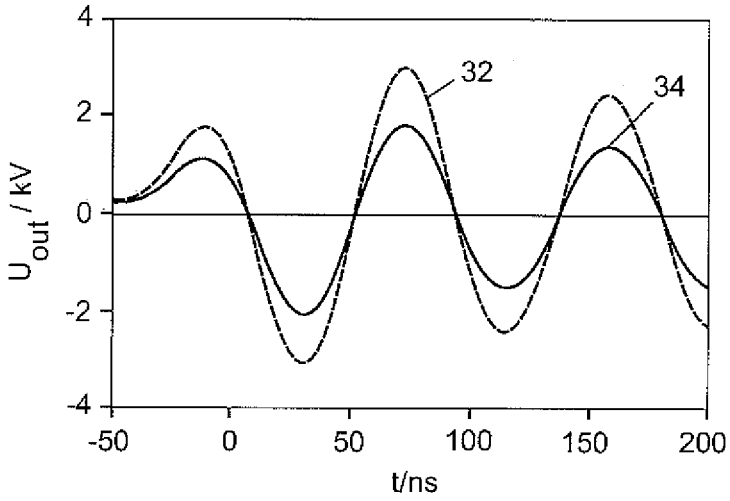
Figure 4:
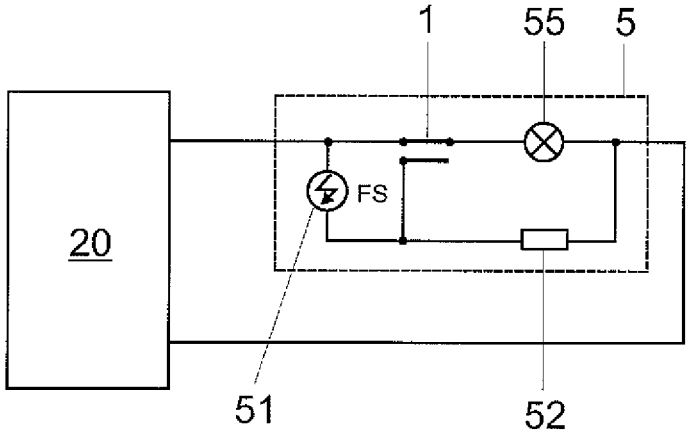

FIG. 3 is a diagram showing the output voltage of a round spiral pulse generator according to the prior art compared with an oval spiral pulse generator according to the invention, and FIG. 4 is a circuit diagram of the wiring of the spiral pulse generator.

DETAILED DESCRIPTION OF THE DRAWINGS

First Embodiment Variant

In the first embodiment variant, which is shown in FIG. 2*a*, the spiral pulse generator has an oval shape. Surprisingly it has been shown that the output voltage of a spiral pulse generator having an oval shape is only approx. ⅓ lower than the output voltage of a comparable round spiral pulse generator. This is illustrated graphically in FIG. 3. The signal 32 shows the output voltage of a round spiral pulse generator, the signal 34 that of an oval spiral pulse generator. It can clearly be seen that the maximum output voltage of the round spiral pulse generator is only about a third higher than the maximum output voltage of the oval spiral pulse generator. A round spiral pulse generator having a diameter similar to the width of an oval spiral pulse generator would generate a significantly lower output voltage.

However, an oval spiral pulse generator can be introduced lengthwise into a cylindrical volume which is limited in diameter but not in length. This is the case with certain high-pressure discharge lamps that have a slim outer piston. The outer piston is too slim to accommodate a suitable round spiral pulse generator, though an oval spiral pulse generator can be introduced without difficulty into the possibly lengthened outer piston of a lamp. The eccentricity of the spiral pulse generator, i.e. the ratio l/b, in other words the ratio of the length l of the spiral pulse generator to its width b, amounts in this case to between 1 and 10, particularly preferably to between 1.5 and 3.

FIG. 4 shows a wiring scheme of the spiral pulse generator according to the invention that is suitable for ensuring a hot reignition capability of the high-pressure discharge lamp 5. As described above, the spiral pulse generator 1 is installed in the outer piston of the high-pressure discharge lamp 5. Alternatively the spiral pulse generator 1 can also be installed in the base of the high-pressure discharge lamp 5. A spark gap 51 and a charging resistor 52 are also required as part of the wiring. In an appropriately temperature-resistant embodiment the wiring can be disposed jointly in the outer piston of the high-pressure discharge lamp 5 or else in the base of the high-pressure discharge lamp 5. The wiring disposed in the base entails the disadvantage that in an arrangement of the spiral pulse generator 1 in the outer piston of the high-pressure discharge lamp 5 three current feeds must be routed in the outer piston. If there is space for the spiral pulse generator with wiring in the lamp base, only two current feeds are required, though these must be implemented as high-voltage-resistant. Likewise, only two current feeds are required in an arrangement of the spiral pulse generator together with wiring in the outer piston of the high-pressure discharge lamp 5, and these feeds also do not need to be implemented as high-voltage-resistant.

In this case, however, the spiral pulse generator is not used as an 'ignition transformer' as in the prior art, but according to the invention is part of a resonant circuit which utilizes the capacitive properties of the spiral pulse generator. The resonant circuit preferably consists of the output inductance of an electronic control device 20, as well as of the charging resistor 52 and the spiral pulse generator 1. The resonant circuit is excited in such a way that the voltage magnification occurs at the capacitor, i.e. at the spiral pulse generator 1. As a result of the voltage magnification, however, there is present at the spiral pulse generator a voltage which allows the parallel-connected spark gap 51 to break down, thereby triggering the spiral pulse generator. The known ignition pulse of the spiral pulse generator 1 is therefore overlaid by the voltage magnification caused by the resonance circuit, resulting in a higher ignition voltage and also a significantly higher ignition energy for the high-pressure discharge lamp 5. The high-pressure discharge lamp 5 can consequently be ignited more effectively and more reliably. The inventive mode of operation with resonance magnification can, of course, also be used with a known spiral pulse generator from the prior art.

Second Embodiment Variant

The second embodiment variant, which is shown in FIG. 2*b*, differs from the first embodiment variant only in respect of the shape of the spiral pulse generator. In this case the spiral pulse generator has a shape whose outline corresponds to a curve having two opposite parallel straight lines which are in each case connected at two opposite points of the straight line by a semicircle. This shape is known e.g. as the ground plan of the Circus Maximus in Rome. Here, the spiral pulse generator has straight segments, thereby enabling its eccentricity, i.e. its ratio of length l to width b, to increase further; in this case too the eccentricity of the spiral pulse generator lies between 1 and 10, particularly preferably between 1.5 and 3.

Excellent starting of a high-pressure discharge lamp 5 can be provided by means of such a spiral pulse generator 1 and an appropriate configuration of the wiring and of the electronic control device according to FIG. 4. In the following it is proposed to disclose an exemplary implementation which could have a configuration consisting of an inventive high-pressure discharge lamp 5 together with the inventive spiral pulse generator 1. The inventive spiral pulse generator in this case has a capacitance of approximately 180 nF. In order to ensure a good resonance behavior a quality of 10 is necessary for the spiral pulse generator 1. The line and charging resistor 52 has a resistance value of approximately 5Ω. The choke (not shown in FIG. 4) of the electronic control device 20 has an inductance value of approximately 0.45 mH. This yields a resonance frequency of the resonant circuit of approximately 17.7 kHz. If the electronic control device has an output voltage of 200V, a voltage of approx. 2000V is present at the spiral-pulse generator 1 at said frequency. The voltage at the spiral pulse generator is therefore increased tenfold compared to the output voltage of the electronic control device. The output voltage of the electronic control device is considered in this case to be the voltage that the electronic control device supplies to the lamp prior to ignition. Normally an ignition device is additionally disposed between electronic control device 20 and high-pressure discharge lamp 5, which ignition device generates an ignition voltage of 2-2.5 kV from the 200V output voltage of the control device for the purpose of cold-igniting the high-pressure discharge lamp. This is no longer necessary in the case of the high-pressure discharge lamp according to the invention, since the ignition device is already integrated in the lamp in the form of the wired spiral pulse generator 1. Because the inventive spiral pulse generator with its eccentricity can generate a high ignition voltage in the double-digit kV range from the charging voltage it is possible to produce a hot-reignitable high-pressure discharge lamp which can be connected directly to an only slightly modified electronic control device.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. A high-voltage pulse generator based on a spiral pulse generator, wherein the spiral pulse generator is implemented as a low temperature co-fired ceramic (LTCC) component and is wound from at least two ceramic sheets and at least two electrically conducting layers, wherein the high-voltage pulse generator is introduced into a cylindrical volume $V=d2*\pi*3*d$ whose length is three times as long as the diameter of the volume, and the volume of the high-voltage pulse generator is greater than one third of the cylindrical volume.

2. The high-voltage pulse generator as claimed in claim 1, wherein the high-voltage pulse generator has a hollow cylindrical shape departing from circularity.

3. The high-voltage pulse generator as claimed in claim 2, wherein the outline of the high-voltage pulse generator corresponds to a closed curve departing from circularity.

4. The high-voltage pulse generator as claimed in claim 3, wherein the outline of the high-voltage pulse generator has an oval shape.

5. The high-voltage pulse generator as claimed in claim 4, wherein the side view of the high-voltage pulse generator corresponds to the shape of an oval ring.

6. The high-voltage pulse generator as claimed in claim 3, wherein the outline of the high-voltage pulse generator corresponds to a curve having two opposite parallel straight lines which are in each case connected at two opposite points of the straight line by a semicircle.

7. The high-voltage pulse generator as claimed in claim 6, wherein the side view of the high-voltage pulse generator corresponds to the shape of a ring whose outline corresponds to two opposite parallel straight lines which are in each case connected at two opposite points of the straight line by a semicircle.

8. The high-voltage pulse generator as claimed in claim 1, wherein eccentricity of the generator is between 1 and 10.

9. The high-voltage pulse generator as claimed in claim 1, wherein eccentricity of the generator is between 1.5 and 3.

10. A high-pressure discharge lamp having a tubular outer piston, wherein the outer piston of the high-pressure discharge has a high-voltage pulse generator as claimed in claim 1.

11. The high-pressure discharge lamp as claimed in claim 10, wherein the outer piston has an internal diameter of 18-25 mm.

12. The high-pressure discharge lamp as claimed in claim 10, wherein the high-pressure discharge lamp additionally has a wiring of the spiral pulse generator adapted to enable the charging voltage of the spiral pulse generator to be generated by means of resonance magnification.

13. The high-pressure discharge lamp as claimed in claim 12, wherein the wiring is accommodated in the lamp base.

14. The high-pressure discharge lamp as claimed in claim 10, wherein the wiring is accommodated with the spiral pulse generator in the outer piston of the high-pressure discharge lamp.

* * * * *